US007490616B2

(12) United States Patent
Gueret

(10) Patent No.: US 7,490,616 B2
(45) Date of Patent: Feb. 17, 2009

(54) APPLICATOR AND DEVICE FOR PACKAGING AND APPLYING A SUBSTANCE

(75) Inventor: Jean-Louis H. Gueret, Paris (FR)

(73) Assignee: L'Oréal S.A., Paris (FR)

( * ) Notice: Subject to any disclaimer, the term of this patent is extended or adjusted under 35 U.S.C. 154(b) by 502 days.

(21) Appl. No.: 10/854,152

(22) Filed: May 27, 2004

(65) Prior Publication Data

US 2005/0011532 A1 Jan. 20, 2005

Related U.S. Application Data

(60) Provisional application No. 60/484,284, filed on Jul. 3, 2003.

(30) Foreign Application Priority Data

May 27, 2003 (FR) ..... 03 06402

(51) Int. Cl.
*A45D 40/26* (2006.01)
*A46B 11/00* (2006.01)

(52) U.S. Cl. ..... 132/218; 401/129

(58) Field of Classification Search ..... 132/218, 132/318, 320; 401/122–124, 127, 129, 126
See application file for complete search history.

(56) References Cited

U.S. PATENT DOCUMENTS

| | | | | |
|---|---|---|---|---|
| 4,365,642 | A | 12/1982 | Costa | |
| 5,899,622 | A | 5/1999 | Gueret | |
| 6,096,382 | A * | 8/2000 | Gueret | 427/463 |
| 6,343,607 | B1 * | 2/2002 | Gueret | 132/218 |
| 6,408,857 | B1 | 6/2002 | Neuner | |
| 2002/0054783 | A1 | 5/2002 | Gueret | |

FOREIGN PATENT DOCUMENTS

| | | |
|---|---|---|
| CN | 1178659 | 4/1998 |
| CN | 1203175 | 12/1998 |
| CN | 1302576 | 7/2001 |
| JP | 56-91508 | 7/1981 |
| JP | 06-60471 | 8/1994 |
| JP | 2001-204543 | 7/2001 |

OTHER PUBLICATIONS

Official Action issued by the Japanese Patent Office on Mar. 2, 2007.
English-language translation of the Official Office Action, no date has been provided.
English-language translation of JP 56-91508, no date has been provided.
English-language translation of JP 06-60471, no date has been provided.

* cited by examiner

*Primary Examiner*—Robyn Doan
(74) *Attorney, Agent, or Firm*—Finnegan, Henderson, Farabow, Garrett & Dunner, L.L.P.

(57) ABSTRACT

An applicator configured to apply a substance to keratinous fibers may include a support, at least one strip associated with the support, and a plurality of applicator elements including at least one of hooks and loops. The applicator elements may extend from the at least one strip. The at least one strip may include at least one projection from which at least some of the applicator elements extend, the projection may subdivide the at least one strip into two portions, and the applicator elements may extend from each of the two portions.

50 Claims, 5 Drawing Sheets

APPLICATOR AND DEVICE FOR PACKAGING AND APPLYING A SUBSTANCE

This application claims the benefit of priority under 35 U.S.C. § 119(e) of U.S. provisional application No. 60/484,284, filed on Jul. 3, 2003.

The present invention relates to an applicator and/or device for applying substances (e.g., cosmetic products and/or care products) to keratinous fibers. For example, the applicator and/or device may be used to apply cosmetic products such as those defined in Counsel Directive 93/35/EEC (European Economic Community) dated Jun. 14, 1993, which provides one non-limiting, exemplary definition of cosmetic products. (Other definitions are also possible.) Some examples of the invention may relate to an applicator and/or device for applying cosmetic products to the eyelashes and/or the eyebrows.

In the field of devices for applying cosmetic products to the eyelashes, U.S. Pat. No. 4,365,642 discloses an applicator including a stem and a plurality of hook-shape filaments projecting from a substrate mounted on the stem. The stem is generally cylindrical or frustoconical in shape (i.e., having a circular cross-section), and the hook-shaped filaments are constituted by the hooks of a VELCRO® strip.

There exists a need to further improve applicators and/or devices for applying substance to keratinous fibers, and, for example, to benefit from an applicator that renders it possible for keratinous fibers to be coated with the substance, for the keratinous fibers to be separated, and/or for the substance to be smoothed on the surface of the keratinous fibers.

There also exists a need to benefit from an applicator and/or device enabling two different makeup effects to be obtained, for example, a makeup effect with a relatively large amount of substance, and a makeup effect having relatively less substance.

There also exists a need to benefit from an alternative to conventional mascara brushes which, for example, because of the presence of a metal core, may be unsuitable for being placed in a microwave oven in order to raise the temperature of the substance.

The invention, for example, may seek to satisfy some or all of the above-mentioned needs.

Although the present invention may obviate one or more of the above-mentioned needs, it should be understood that some aspects of the invention might not necessarily obviate one or more of those needs.

In the following description, certain aspects and embodiments will become evident. It should be understood that the invention, in its broadest sense, could be practiced without having one or more features of these aspects and embodiments. It should be understood that these aspects and embodiments are merely exemplary.

In one aspect, as embodied and broadly described herein, the invention includes an applicator configured to apply a substance to keratinous fibers. The applicator may include a support, at least one strip associated with the support, and a plurality of applicator elements including at least one of hooks and loops. The applicator elements may extend from the at least one strip. The at least one strip may include at least one projection from which at least some of the applicator elements extend, and the projection may subdivide the at least one strip into two portions. The applicator elements may extend from each of the two portions.

According to one aspect, the keratinous fibers may include at least one of eyelashes and eyebrows.

According to yet another aspect, the projection may define, at at least one location, a radius of curvature and at least one of the portions may define a radius of curvature. The radius of curvature of the projection may differ from the radius of curvature of the at least one portion. In a further aspect, the projection may be defined by a fold in the strip. In still another aspect, the projection may be defined by an edge of the strip.

In yet another aspect, each of the two portions may define a radius of curvature, and the radius of curvature of one portion may differ from the radius of curvature of the other portion.

Some applicator elements may be located at the projection (e.g., a surface irregularity), and may be used to obtain a first makeup effect, and the applicator elements extending from other portions of the applicator may be used to obtain a different makeup effect.

According to a further aspect, the support may include at least one channel in fluid communication with a supply of the substance. In yet another aspect, the at least one strip may include at least one passage in fluid communication with the channel.

In still a further aspect, the at least one strip may define, at least one location, a radius of curvature that is less than or equal to about 5 millimeters, for example, less than or equal to about 4 millimeters, for example, less than or equal to about 3 millimeters, for example, less than or equal to about 2 millimeters (e.g., less than or equal to about 1 millimeter).

According to yet another aspect, an applicator configured to apply a substance to keratinous fibers may include a support, at least one strip associated with the support, and a plurality of applicator elements including at least one of hooks and loops extending from the at least one strip. The support may define a surface not having a slot and having at least two different radii in a single cross-section plane. For example, the smaller of the two different radii may be less than or equal to about 4 millimeters, for example, less than or equal to about 3 millimeters, for example, less than or equal to about 2 millimeters, for example, less than or equal to about 1 millimeter (e.g., less than or equal to about one-half a millimeter).

According to another aspect, a device for packaging and applying a substance may include a receptacle for containing the substance, and an applicator. In still another aspect, the substance may include at least one of a cosmetic product and a care product.

In still another aspect, a method for applying makeup may include providing an applicator, and using the applicator to obtain at least one of two different makeup effects. One make-up effect may be obtained using applicator elements situated on a first of the two different radii, and another make-up effect may be obtained using applicator elements situated on a second of the two different radii.

The term "providing" is used in a broad sense, and refers to, but is not limited to, making available for use, enabling usage, giving, supplying, obtaining, getting a hold of, acquiring, purchasing, manufacturing, selling, distributing, possessing, making ready for use, and/or placing in a position ready for use.

According to some aspects, the invention may render it possible to benefit from a distribution of applicator elements on the applicator that is suitable specifically for separating the eyelashes and/or for smoothing the substance on the surface thereof. In some embodiments, the small radius of curvature of the strip may serve, for example, to include a row of applicator elements between which the eyelashes may be more easily engaged, for example, in order to be separated.

For example, the applicator may be configured in such a manner that the at least one strip includes at least one face that is substantially planar and/or curved with a relatively large radius of curvature (e.g., greater than 2 millimeters), and at least one edge and/or fold. The substantially planar and/or curved face may be used, for example, for coating substance onto the eyelashes, while the applicator elements situated on the edge and/or the fold may be used for separating the eyelashes and/or for smoothing the substance on the surface of the eyelashes. Such an exemplary applicator may be formed entirely without any metal, and it may be used to replace conventional mascara brushes, for example, which have metal cores. The absence of metal may render the applicator compatible with being placed in a microwave oven (e.g., when heating the substance with a microwave oven).

According to yet another aspect, the at least one strip may be heat-sealed to the support. In still another aspect, the at least one strip may be bonded to the support via adhesive. In yet another aspect, the at least one strip may be fastened to the support in some other fashion, such as, for example, the support may be overmolded on the strip. In some aspects, the at least one strip may be held, at least in part, on the support by a fastener.

In yet another aspect, the at least one strip may include a first face and a second face opposite the first face, and the applicator elements may extend from the first face. For example, the at least one strip may be folded double such that the first face is beside the second face. In another aspect, the second face may include adhesive. Adhesive properties of the second face may render it easier to manufacture the applicator, for example, by ensuring that the at least one strip is definitively fastened to the support and/or by holding the applicator on the support while waiting for a fastening operation (e.g., fastening via heat-sealing and/or fastening via a fastener). The at least one strip may include at least one face that is substantially planar, and, for example, two opposite faces that are substantially planar, for example, when the at least one strip has been folded double. The at least one strip may include at least one fold, and the fold line may define a zone in which the radius of curvature is less than or equal to about 2 millimeters.

According to a further aspect, the at least one strip may be fastened on the support such that the strip substantially matches the shape of the support. For example, the support may define a surface on which the strip rests, and the surface may define, at at least one location, a radius of curvature that is less than or equal to about 5 millimeters, for example, less than or equal to about 4 millimeters, for example, less than or equal to about 3 millimeters, for example, less than or equal to about 2 millimeters. This location may roughly correspond to an edge, for example, and the edge may be situated at a junction between two surfaces of the support that have different orientations.

According to another aspect, the support may define a cross-section that is not circular. For example, according to some aspects, the support defines a cross-section that is one of substantially polygonal and oblong. In some aspects, the strip defines at least one face that is substantially planar. According to yet another aspect, the strip may be fastened on the support such that the strip substantially matches the shape of the support.

In another aspect, the support may be partially covered by the strip, for example, so as to render it possible for the support to be configured with at least one row of teeth, which may be situated between two edges of the strip, for example. In some aspects, the strip may include a face, wherein only a portion of the face contacts the support, such that, for example, a portion of the face in the vicinity of the projection is not in contact with the support.

In a further aspect, the applicator elements may define an envelope surface, and the support may include a proximal portion that is larger than the envelope surface, so as to, for example, protect the applicator elements when going through a wiper member.

According to another aspect, the strip may be formed from a material that is natural and/or synthetic. For example, in some aspects, the strip may include at least one of a woven and non-woven fabric. According to one aspect, the strip may include flocking.

In still another aspect, each of the applicator elements may define a hook shape. In yet a further aspect, each of the applicator elements may define a loop shape. For example, according to one aspect, the applicator elements include hooks formed via cutting loop shapes.

In yet another aspect, the applicator elements may include bases that are distributed in a substantially uniform manner over the strip. In still a further aspect, the applicator elements may define free ends having random orientations.

In yet a further aspect, the applicator elements may have a height dimension less than or equal to about 4 millimeters, for example, less than or equal to about 2 millimeters (e.g., about one-half millimeter).

According to yet another aspect, the strip may include at least one opening. For example, the strip may include at least one slot, which may, for example, contribute to increasing the quantity of substance loaded onto the applicator, and consequently the length of time the applicator may be used before reloading the applicator with more substance.

In still another aspect, the strip may be fastened around the support and may at least partially overlap itself. In some aspects, the strip may have two edges that are not superposed, that are touching, or that are not touching one another.

According to yet another aspect, that device may include a stem having one end associated with the support. In some aspects, the stem may have another end associated with a cap configured to close a receptacle.

In still a further aspect, the support may include at least one channel in fluid communication with a supply of substance. In some aspects, the strip may be permeable to the substance and may include at least one passage in fluid communication with the channel.

In yet another aspect, a device for packaging and applying a substance may include a receptacle for containing the substance and an applicator. In some aspects, the substance may include at least one of a cosmetic product and a care product.

In still another aspect, the device may include a wiper member configured to wipe an applicator, for example, when the applicator is inserted into a receptacle in order to be loaded with substance. In some aspects, the applicator may be loaded with substance in some other fashion, for example, by contacting a cake of substance.

In still another aspect, a method for applying makeup may include providing an applicator, and using the applicator to obtain at least one of two different makeup effects. The one make-up effect may be obtained using applicator elements situated on the projection, and another make-up effect may be obtained using applicator elements situated on at least one of the portions.

In yet a further aspect, an applicator configured to apply a substance to keratinous fibers may include a support, at least one strip associated with the support, and a plurality of applicator elements including at least one of hooks and loops extending from the at least one strip. The cross-section of the support may be non-circular in shape.

As used herein, the term "non-circular in shape" means a shape defined by a peripheral outline that does not have a substantially constant radius. In contrast to a non-circular shape, the stem of U.S. Pat. No. 4,365,642 has a circular shape, which defines a peripheral shape that has a substantially constant radius.

According to a further aspect, an applicator configured to apply a substance to keratinous fibers may include a support, at least one strip associated with the support, and a plurality of applicator elements including at least one of hooks and loops extending from the at least one strip. The at least one strip may be fastened to the support via a fastener fitted to the support.

In yet another aspect, an applicator configured to apply a substance to keratinous fibers may include a support defining at least one longitudinal edge not defining a slot, at least one strip associated with the support, and a plurality of applicator elements including at least one of hooks and loops extending from the at least one strip.

In a further aspect, an applicator configured to apply a substance to keratinous fibers may include a support, at least one strip associated with the support, and a plurality of applicator elements including at least one of hooks and loops extending from the at least one strip. The at least one strip may define at least one portion folded double defining a pair of substantially co-extensive side faces forming a cross-sectional length dimension. The support may be located adjacent one end of the cross-sectional length dimension.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of this specification. The drawings illustrate exemplary embodiments of the invention and, together with the description, serve to explain some principles of the invention. In the drawings, FIG. 1 is a schematic, partial cross-section view of one embodiment of a device for packaging and applying a substance to keratinous fibers;

Reference will now be made in detail to some possible embodiments of the invention, examples of which are illustrated in the accompanying drawings. Wherever possible, the same reference numbers are used in the drawings and the description to refer to the same or like parts.

Figure 1:
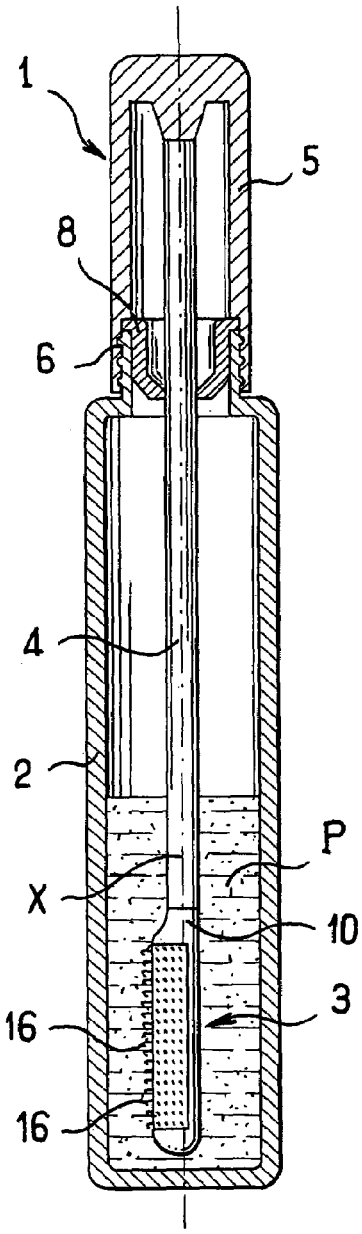

FIG. 1 depicts an exemplary embodiment of a device 1 for packaging and applying a substance that includes a receptacle 2 containing a substance P for application to keratinous fibers (e.g., a mascara for applying to eyelashes) and an applicator 3 including a stem 4 (e.g., a rectilinear stem) defining an axis X, which may be secured at a top end to a closure cap 5 configured to be threaded onto a neck 6 of the receptacle 2. The receptacle 2 may include a wiper member 8 configured to wipe the applicator 3 while it is being-extracted from the receptacle 2.

According to the exemplary embodiment depicted in FIG. 1, the stem 4 is rectilinear. In a variant of that embodiment, however, the stem 4 may be curved. The wiper member 8 may be of any known type. For example, the wiper member 8 may include an elastomer lip optionally provided with slots and/or it may include a split block of foam.

Figure 3:
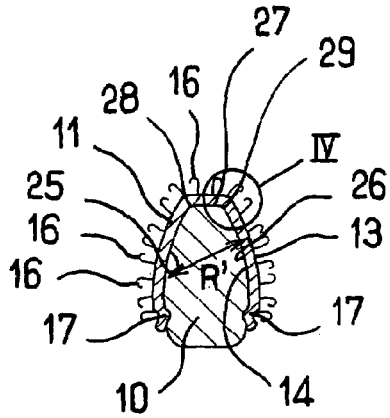
FIG. 3 is a section view along line III-III of FIG. 2.
Figure 2:
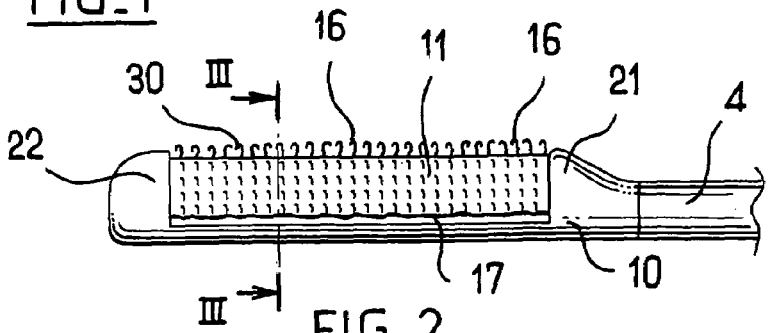
FIG. 2 is a schematic partial view a portion of the device of FIG. 1.
Figure 5:
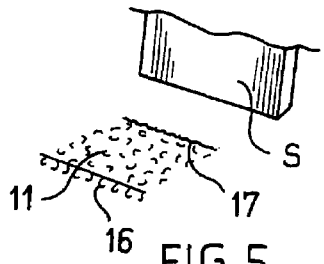
FIG. 5 is a schematic, partial view of one embodiment of a method for forming one embodiment of an applicator for applying a substance to keratinous fibers.

According to some embodiments, the applicator 3 includes a support 10 fixed to the bottom end of the stem 4. For example, in the exemplary embodiment depicted in FIGS. 2 and 3, the support 10 is associated with a strip 11 (e.g., a flexible strip) defining a first face 13 and a second face 14 opposite the first face. A plurality of applicator elements 16 may extend from the first face 13, and the second face 14 may be fastened to the support 10. According to some embodiments, the strip 11 may be formed from VELCRO®-type material and may be a textile, and the second face 14 may include an adhesive. The strip 11 may be fastened to the support 10 solely by the adhesion of the second face 14. According to some embodiments, the strip 11 may be heat-sealed to the support 10 (e.g., close to the strip's 11 longitudinal edges) along lines of fastening 17 and/or by adhesion of the second face 14 to the support 10. For example, the heat-sealing may be performed by pressing a heat-sealing tool S (see, e.g., FIG. 5) against the strip 11 after it has been placed on the support 10.

According to some embodiments, the thickness of the strip 11 may be less than or equal to about 1 millimeter, for example, the strip 11 may be less than or equal to about one-half a millimeter. The support 10 may be shaped with a proximal portion 21 and a distal portion 22 that are tapered so as to, for example, make it easier for the applicator 3 to pass through the wiper member 8. According to some embodiments, for example, the embodiment depicted in FIG. 4, the strip 8 defines, at at least one location, a surface irregularity, such as a projection. The surface irregularity may include a portion having a radius of curvature R that is less than or equal to about 2 millimeter. This radius of curvature R is measured on the first face 13 in a cross-sectional plane.

Figure 4:
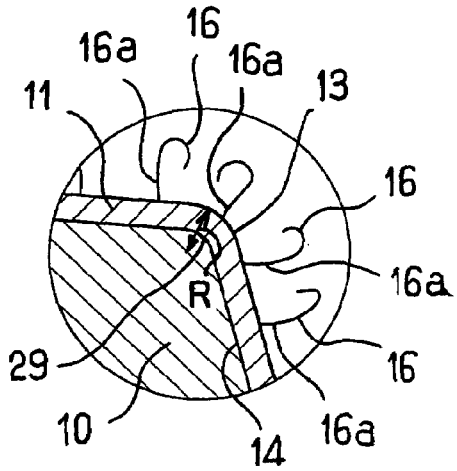
FIG. 4 is a view of detail IV of FIG. 3.

In the exemplary embodiment depicted in FIG. 4, the support 10 defines two faces 25 and 26 (e.g., opposite side faces), which are slightly outwardly convex, being connected together by a face 27. Face 27 cooperates with the faces 25 and 26 to define respective longitudinal edges 28 and 29, which present a radius of curvature that is less than or equal to about 2 millimeters in the cross-section depicted schematically in FIG. 3. The strip 11 may locally contact longitudinal edges 28 and 29 and define a radius of curvature that is less than or equal to about 2 millimeters. The faces 25 and 26 may define a radius of curvature R', at at least one location, that is greater than R.

The shape of the support 10 may render it possible (e.g., along the relatively narrow face 27 of the applicator 3) to obtain a succession 30 of applicator elements 16 capable of, for example, separating the eyelashes, whereas the applicator elements 16 covering the faces 25 and 26 may be capable of, for example, picking up a relatively large quantity of substance for application to the eyelashes.

According to some embodiments, it may be possible to have an applicator 3 with at least two regions in which the bases 16*a* of the applicator elements 16 may be oriented in a manner that varies differently from one applicator element 16 to another. Thus, at the junction between the face 27 and either one of the faces 25 and 26, the orientation of the bases 16*a* of the applicator elements 16 substantially normal to the first face 13, may vary greatly (e.g., as can be seen in FIG. 4), given the relatively small radius of curvature R, whereas on each of the faces 25 or 26, the bases 16*a* are substantially parallel to one another and/or present orientations that vary relatively little.

Figure 6:
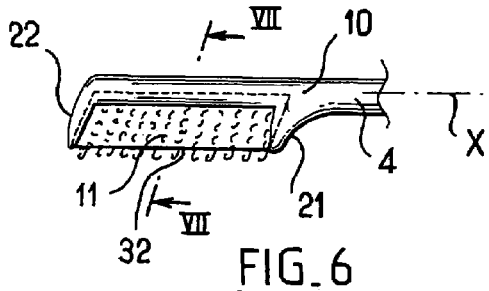
FIG. 6 is a schematic, partial view of an embodiment of an applicator.
Figure 7:
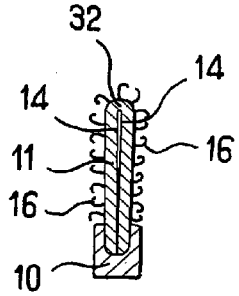
FIG. 7 is a section view along line VII-VII of FIG. 6.

The strip 11 may be fastened in various ways to the support 10. For example, the support 10 may be overmolded onto the strip 11, as shown in FIGS. 6 and 7. It can be seen in FIGS. 6 and 7, for example, that the strip 11 can be folded double against its second face 14 prior to the support 10 being overmolded thereon, in which case the strip 11 may define a shape that is, for example, substantially rectangular. The fold line 32 may include a region in which the radius of curvature of the strip 11 (i.e., as measured in a plane perpendicular to the longitudinal axis X of the applicator 3) is relatively small, for example, less than or equal to about 2 millimeters. The support 10 may be overmolded onto the strip 11 and may cover the edge thereof that is remote from the fold line 32 along with the two edges adjacent to the proximal and distal portions 21 and 22 of the support 10. During the overmolding, the material forming the applicator elements 16 may melt and mix with the material forming the support 10. In exemplary embodiments having a second face 14 that includes adhesive, the adhesive may contribute to holding the strip 11 folded double, for example, during the overmolding operation.

In the exemplary embodiment depicted in FIGS. 6 and 7, the strip 11 defines two faces (e.g., opposite faces) having applicator elements 16 extending therefrom. The two faces are substantially planar and have applicator elements 16 along the fold line 32 that are suitable for use in separating the eyelashes. As shown in FIG. 6, for example, the support 10 may be formed integrally with the stem 14 in a single molding operation. The support 10 and the strip 11, which may substantially surround either all or part of the support 10, may define a variety of shapes other than those described above. Some exemplary shapes are shown schematically in FIGS. 8 through 16 and are described in more detail below.

Figure 8:
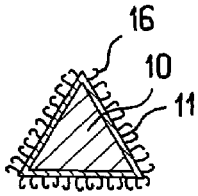
FIG. 8 is a schematic cross-section view of one embodiment of an applicator.

As depicted in FIG. 8, the support 10 may define a polygonal (e.g., triangular) cross-section, and the strip 11 may cover all of the sides of the polygonal shape. The applicator elements 16 may be situated along the edges and may be used for separating the eyelashes. In the exemplary embodiment of FIG. 8, the faces of the support 10 define the sides of a triangle and are substantially planar. It would not go beyond the ambit of the present invention for them, however, to be given a slightly curved shape, convex and/or concave, with respect to the exterior of the applicator 3.

Figure 9:
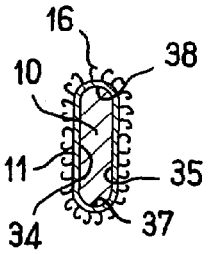
FIG. 9 is a schematic cross-section view of another embodiment of an applicator.

As depicted in FIG. 9, the support 10 may have a generally flat cross-section (e.g., defining two opposite side faces 34 and 35 that are substantially planar and/or parallel) interconnected by two semi-cylindrical surfaces 37 and 38, each having a radius of curvature that is less than or equal to about 2 millimeters.

Figure 10:
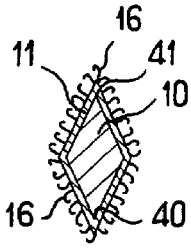
FIG. 10 is a schematic cross-section view of a further embodiment of an applicator.

As depicted in FIG. 10, the support 10 may have a generally lozenge-shaped cross-section, defining at least two opposite edges 40 and 41, each having a radius of curvature that is less than or equal to about 2 millimeters in a plane substantially perpendicular to the longitudinal axis X.

Figure 11:
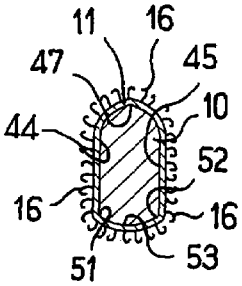
FIG. 11 is a schematic cross-section view of another embodiment of an applicator.

As depicted in FIG.11, the support 10 may have a cross-section defining two opposite side faces 44 and 45 that are substantially planar, which are united on one side by a semi-cylindrical face 47, whose radius of curvature may be greater than or equal to about 2 millimeters, for example. The face 47 tangentially connects to the side faces 44 and 45. On a side opposite from the face 47, the support 10 may define a face 53, which is connected non-tangentially to the side faces 44 and 45, thereby defining edges 51 and 52, each of which may have a radius of curvature that is less than or equal to about 2 millimeters. The face 53 may be at least slightly convex with respect to the exterior of the applicator 3, as shown.

Figure 12:
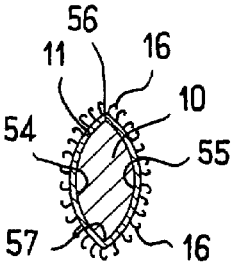
FIG. 12 is a schematic cross-section view of a further embodiment of an applicator.

As depicted in FIG. 12, the support 10 may have a lens-shaped cross-section, for example, having two opposite outwardly-convex side faces 54 and 55 joined by edges 56 and 57, either or both of which may have a radius of curvature less than or equal to about 2 millimeters.

Figure 13:
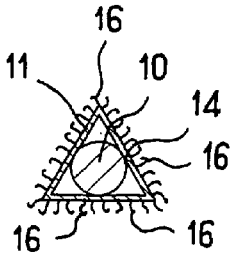
FIG. 13 is a schematic cross-section view of another embodiment of an applicator.

As depicted in FIG. 13, the entire second face 14 of the strip 11 may not necessarily be in contact with the support 10. For example, the support 10 may define a substantially circular cross-section, and the strip 11 may define, for example, a polygonal-shaped cross-section (e.g., a triangular cross-section that contacts the support 10 in the vicinity of the midpoints of the sides of the triangle). The strip 11 may, for example, define three edges, each having a radius of curvature less than or equal to about 2 millimeters, which may be suitable for separating the eyelashes. The strip 11 may be fastened to the support 10 via adhesive on the second face 14 of the strip 11, although fastening of the strip 11 and the support 10 to one another may be obtained via heat-sealing instead of, or in addition to, using adhesive.

Figure 14:
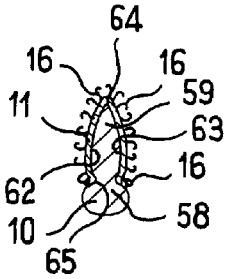
FIG. 14 is a schematic cross-section view of a further embodiment of an applicator.

As depicted in FIG. 14, the support may include a bottom portion 58 that is not covered by the strip 11, and a top portion 59 that is generally flat in shape and that is covered by the strip 11. The top portion 59 includes two opposite side faces 62 and 63, which converge upwards toward each other and define an edge 64 at their junction. At the junction between the bottom and top portions 58 and 59, the support 10 may define two longitudinal grooves 65 in which the strip 11 may be heat-sealed and/or adhesively secured to support 10.

Figure 15:
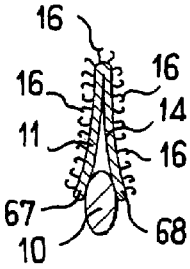
FIG. 15 is a schematic cross-section view of another embodiment of an applicator.

As depicted in FIG. 15, the strip 11 may cover only a portion of the support 10, and may be connected to the support 10 via two end portions 67 and 68 that are fastened to the support 10, for example, via adhesive and/or heat-sealing. The strip 11 may include a top portion, which is folded double and fastened to the support 10 via its second face 14.

Figure 16:
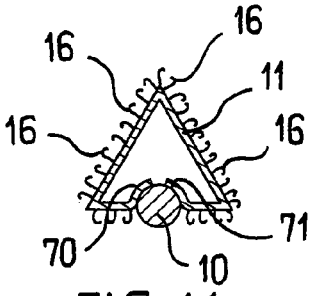
FIG. 16 is a schematic cross-section view of a further embodiment of an applicator.
Figure 17:
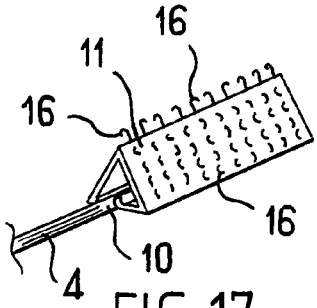
FIG. 17 is a schematic, partial perspective view of a portion of the applicator of FIG. 16.

In the exemplary embodiment depicted in FIGS. 16 and 17, the strip 11 includes two end portions 70 and 71 that are fastened to the support 10, and the remainder of the strip 11 is shaped to have a hollow cross-section (e.g., a generally triangular cross-section) that extends from one side of the support 10.

Figure 18:
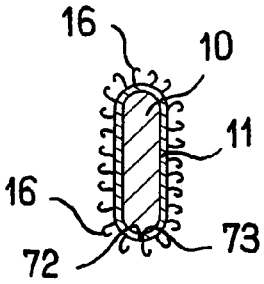
FIG. 18 is a schematic cross-section view of another embodiment of an applicator.
Figure 19:
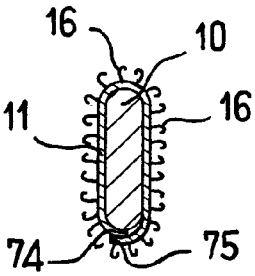
FIG. 19 is a schematic cross-section view of a further embodiment of an applicator.
Figure 20:
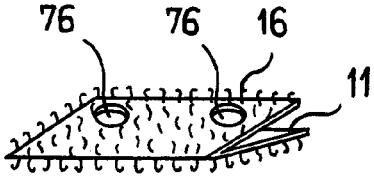
FIG. 20 is a schematic perspective view of one embodiment of a portion of an applicator.
Figure 21:
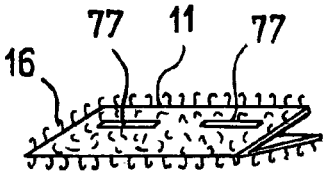
FIG. 21 is a schematic perspective view of another embodiment of a portion of an applicator.

According to some exemplary embodiments, the strip 11 may be fixed to the support 10 via two edges 72 and 73 that contact one another, as depicted in FIG. 18, or the strip 11 may be fixed to the support via two end portions 74 and 75 that overlap one another, as depicted in FIG. 19. For example, when folded double, the strip 11 may include one or more perforations (e.g., circular openings 76 and/or slot-shaped openings 77, as depicted in FIGS. 20 and 21, respectively). Such openings 76 and/or slots 77 may enable the quantity of substance loaded onto the applicator 3 to be increased (i.e., by establishing supplies of substance that are not wiped away (e.g., when the device 1 includes a wiper member 8)).

Figure 26:
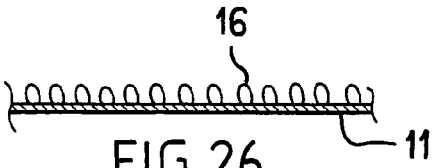
FIG. 26 is a schematic, partial section view of a further embodiment of a portion of an applicator.
Figure 23:
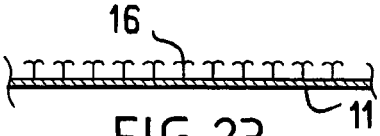
FIG. 23 is a schematic, partial section view of another embodiment of a portion of an applicator.
Figure 24:
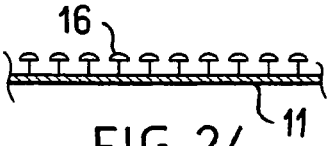
FIG. 24 is a schematic, partial section view of a further embodiment of a portion of an applicator.
Figure 22:
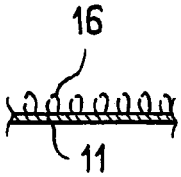
FIG. 22 is a schematic, partial section view of one embodiment of a portion of an applicator.

The applicator elements 16 may define a variety of shapes, and, in particular, shapes that are commonly associated with VELCRO®-like strips (e.g., hook shapes, as shown in FIGS. 22 through 25). As used herein, the term "hook shape" is used very broadly to describe a variety of shapes that may be suitable for providing mechanical hooking, for example, a shape including a cut loop (e.g., as shown in FIG. 22), a fish-hook shape (e.g., as shown in FIG. 23), and/or a mushroom shape (e.g., as shown in FIG. 24). A hook-shaped element may be particularly suitable for hooking onto a loop shape element. According to some embodiments, the applicator elements 16 may not necessarily be in the form of hooks, and could define closed loops (e.g., as shown in FIG. 26).

Figure 25:
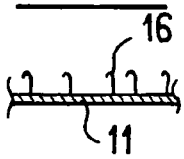
FIG. 25 is a schematic, partial section view of another embodiment of a portion of an applicator.

According to some embodiments, the distribution of applicator elements 16 on a strip 11 may be either uniform, non-uniform (e.g., as shown in FIG. 25), or both. A non-uniform distribution of applicator elements 16 may obtained, for example, via a treatment to which the applicator 3 has been subjected after the strip 11 has been fastened to the support 10.

Figure 27:
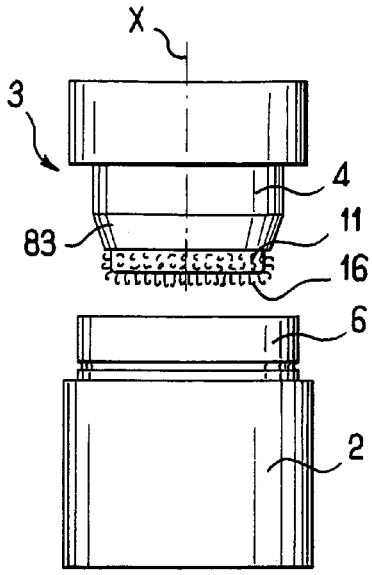
FIG. 27 is a schematic elevation view of one embodiment of a device for packaging and applying a substance.
Figure 28:
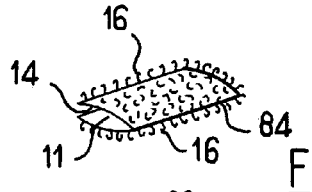
FIG. 28 is a schematic perspective view of a portion of the device of FIG. 27.
Figure 29:
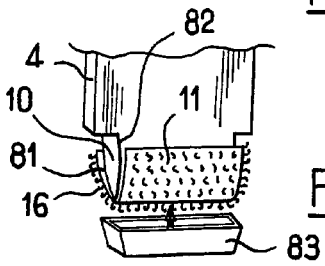
FIG. 29 is a schematic, partial perspective view of portions of the device of FIG. 27 in one configuration.
Figure 30:
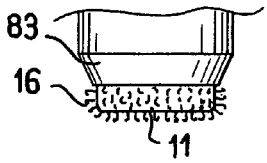
FIG. 30 is a partial schematic view of a portion of the device of FIG. 27.

FIG. 27 depicts another exemplary embodiment of a device 1 for packaging and applying a substance. In such an exemplary device, the stem 4 of the applicator 3 is relatively flat, and the applicator 3 may be, for example, fixed to the neck 6 of the receptacle 2 via snap-fastening and/or other fastening methods and/or structures. The support 10 may be formed integrally with the stem 4, and the strip 11 may be folded along a fold line 84 (e.g., as shown in FIG. 28) prior to (or after) being placed on the support 10 such that opposite side faces 81 and 82 are substantially covered (e.g., as shown in FIG. 29). The strip 11 may be fixed to the support 10 via adhesive, via heat-sealing, and/or via a fastener 83 (e.g., see FIGS. 27, 29, and 30) fitted to the support 10 (e.g., via a ring) and may be assembled to the stem 4 via snap-fastening, adhesive, and/or heat-sealing. The exemplary fastener 83 holds the strip 11 against the support 10. Only a portion of the strip 11 adjacent to the fold line 84 may project beyond the fastener 83, for example, in order to apply the substance, as depicted, for example, in FIG. 30. According to some exemplary embodiments, the second face 14 of the strip 11 may have adhesive properties, thus enabling the strip 11 to be held in place on the support 10, for example, prior to the fastener 83 being fitted.

As depicted in FIGS. 27 through 30, a fold line 84 may extend substantially perpendicularly to the longitudinal axis X of the applicator 3. The fold line 84 defines a zone having a relatively small radius of curvature in a plane perpendicular thereto, and the applicator elements 16 that extend along the fold line 84 may be used, for example, for separating the eyelashes.

Figure 31:
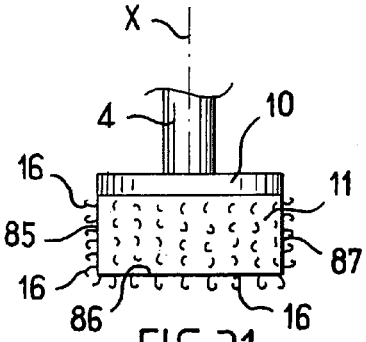
FIG. 31 is a partial schematic view of a portion of one embodiment of an applicator.

As depicted in FIG. 31, the applicator 3 may include applicator elements 16, which are not necessarily located only on opposite faces joined along an edge 86, at a region, and/or at a relatively small radius of curvature. The applicator 3 may include applicator elements 16 extending from end faces 85 and 87 substantially perpendicularly to the edge 86.

Figure 32:
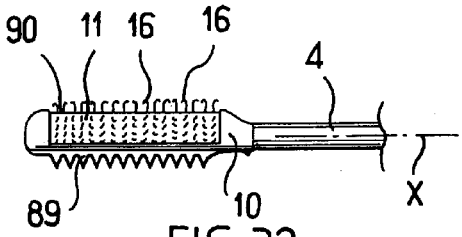
FIG. 32 is a schematic, partial view of another embodiment of an applicator.

As depicted in FIG. 32, the support 10 may include at least one row of teeth 89 (e.g., extending parallel to the longitudinal axis X of the applicator 3). The row of teeth 89 may be located on a side opposite from an edge 90 of the strip 11, and the edge 90 may define a zone having a relatively small radius of curvature in a plane perpendicular to the axis X, for example.

Figure 33:
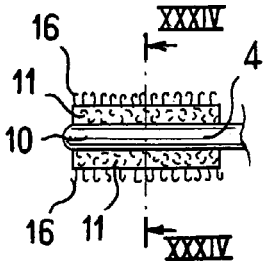
FIG. 33 is a schematic, partial view of a further embodiment of an applicator.
Figure 34:
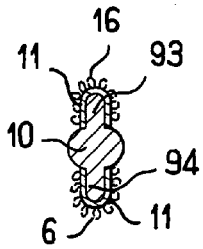
FIG. 34 is section view along line XXXIV-XXXIV of FIG. 33.

As depicted in FIGS. 33 and 34, an applicator 3 may include two strips 11. For example, the support 10 may include two or more extensions (e.g., two extensions 93 and 94), each covered by a respective strip 11 and shaped so that at least one of the strips 11 presents, at at least one location, a radius of curvature that is relatively small.

Figure 35:
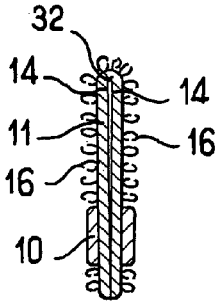
FIG. 35 is a schematic cross-section view of another embodiment of an applicator.

In the exemplary embodiment depicted in FIG. 35, the support 10 is overmolded onto a strip 11 that has been folded double in a manner at least similar to the embodiment schematically shown in FIG. 7. Unlike FIG. 7, however, the strip 11 projects from either side of the support 10.

Figure 36:
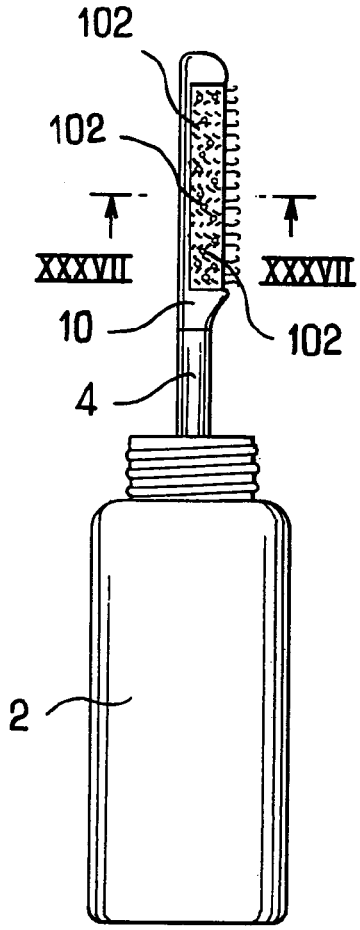
FIG. 36 is schematic, partial view of another embodiment of a device.
Figure 37:
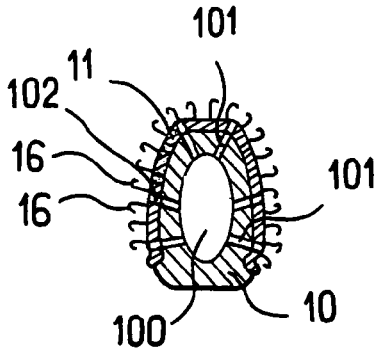
FIG. 37 is a section view along line XXXVII-XXXVII of FIG. 36.

According to some exemplary embodiments, the applicator 3 may be formed so as to be fed with substance from a supply of substance. For example, the substance may be contained in a receptacle 2 (e.g., as shown in FIG. 36), and the support 10 may communicate with the inside of the receptacle 2 via the stem 4, which is hollow. The support 10 may include an internal cavity 100, which communicates via channels 101 with the surface of the support 10 situated beneath the strip 11. The strip 11 may be permeable to the substance and may include at least one orifice 102. In the exemplary embodiment depicted in FIGS. 36 and 37, for example, the strip 11 includes a plurality of orifices 102 extending between at least some of the applicator elements 16, thereby enabling the substance flowing through along the channels 101 to reach the outside surface of the strip 11, so as to be applied to the surface that is to be made up. The substance may flow along the channels 101, for example, under the effect of pressure exerted on the wall of the receptacle 2 (e.g., when receptacle 2 includes elastically deformable walls). The substance may be brought to the exterior surface of the strip 11 via others methods and/or structures (e.g., via a pump (not shown)).

The applicator and/or device according to some exemplary embodiments of the invention may be used to apply cosmetic products and/or care products, such as make-up products, dermatological substances, and/or pharmaceutical compositions used for treating and/or changing the appearance and/or scent of a keratinous surface. However, in its broadest aspects, the present invention could be used to apply many other substances.

Furthermore, sizes of various structural parts and materials used to make the above-mentioned parts are illustrative and exemplary only, and one of ordinary skill in the art would recognize that these sizes and materials can be changed to produce different effects or desired characteristics.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. An applicator configured to apply a substance to keratinous fibers, the applicator comprising:

a support;

at least one strip associated with the support; and a plurality of applicator elements comprising at least one of hooks and loops, the applicator elements extending from the at least one strip, wherein the at least one strip comprises at least one projection from which at least some of the applicator elements of the plurality of applicator elements extend, wherein the projection subdivides the at least one strip into two portions, wherein the applicator elements extend from each of the two portions, and wherein the at least one strip defines, at least one location comprising some of the applicator elements of the plurality of applicator elements, a radius of curvature that is less than or equal to about 2 millimeters.

2. The applicator of claim 1, wherein the keratinous fibers comprise at least one of eyelashes and eyebrows.

3. The applicator of claim 1, wherein the projection defines, at at least one location, a radius of curvature and at least one of the portions defines a radius of curvature, and wherein the radius of curvature of the projection differs from the radius of curvature of the at least one portion.

4. The applicator of claim 1, wherein the projection is defined by a fold in the strip.

5. The applicator of claim 1, wherein the projection is defined by an edge of the strip.

6. The applicator of claim 1, wherein each of the two portions define a radius of curvature, and wherein the radius of curvature of one portion differs from the radius of curvature of the other portion.

7. The applicator of claim 1, wherein the support comprises at least one channel in fluid communication with a supply of the substance.

8. The applicator of claim 7, wherein the strip comprises at least one passage in fluid communication with the channel.

9. The applicator of claim 1, wherein the strip defines, at at least one location, a radius of curvature that is less than or equal to about 1 millimeter.

10. The applicator of claim 1, wherein the strip is heat-sealed to the support.

11. The applicator of claim 1, wherein the strip is bonded to the support via adhesive.

12. The applicator of claim 1, wherein the support is overmolded on the strip.

13. The applicator of claim 1, wherein the strip comprises a first face and a second face opposite the first face, and wherein the applicator elements extend from the first face.

14. The applicator of claim 13, wherein the strip is folded double such that the first face is beside the second face.

15. The applicator of claim 13, wherein the second face comprises adhesive.

16. The applicator of claim 1, wherein the support defines a surface on which the strip rests, and wherein the surface defines, at at least one location, a radius of curvature that is less than or equal to about 2 millimeters.

17. The applicator of claim 1, wherein the support defines a cross-section that is not circular.

18. The applicator of claim 1, wherein the support defines a cross-section that is one of substantially polygonal and oblong.

19. The applicator of claim 1. wherein the strip defines at least one face that is substantially planar.

20. The applicator of claim 1, wherein the strip is fastened on the support such that the strip substantially matches the shape of the support.

21. The applicator of claim 1, wherein the support is partially covered by the strip.

22. The applicator of claim 1, wherein the strip comprises a face, wherein only a portion of the face contacts the support.

23. The applicator of claim 22, wherein a portion of the face in the vicinity of the projection is not in contact with the support.

24. The applicator of claim 22, wherein the applicator elements define an envelope surface, and wherein the support comprises a proximal portion that is larger than the envelope surface.

25. The applicator of claim 1, wherein the strip comprises at least one of a woven and non-woven fabric.

26. The applicator of claim 25, wherein the strip comprises flocking.

27. The applicator of claim 1, wherein each of the applicator elements defines a hook shape.

28. The applicator of claim 1, wherein each of the applicator elements defines a loop shape.

29. The applicator of claim 1, wherein the applicator elements comprise hooks formed via cutting loop shapes.

30. The applicator of claim 1, wherein the applicator elements comprise bases that are distributed in a substantially uniform manner over the strip.

31. The applicator of claim 1, wherein the applicator elements define free ends having random orientations.

32. The applicator of claim 1, wherein the applicator elements have a height dimension less than or equal to about 4 millimeters.

33. The applicator of claim 32, wherein the support comprises at least one row of teeth.

34. The applicator of claim 1, wherein the applicator elements have a height dimension less than or equal to about 2 millimeters.

35. The applicator of claim 34, wherein the support comprises at least one row of teeth.

36. The applicator of claim 1, wherein the strip comprises at least one opening.

37. The applicator of claim 1, wherein the strip comprises at least one slot.

38. The applicator of claim 1, wherein the strip comprises at least one fold.

39. The applicator of claim 1, wherein the strip is fastened around the support and at least partially overlaps itself.

40. The applicator of claim 1, further comprising a stem having one end associated with the support.

41. The applicator of claim 40, wherein the stem has another end associated with a cap configured to close a receptacle.

42. A device for packaging and applying a substance, the device comprising:

receptacle for containing the substance; and the applicator of claim 1.

43. The device of claim 42, wherein the substance comprises at least one of a cosmetic product and a care product.

44. The device of claim 42, further comprising a wiper member configured to wipe the applicator.

45. A method for applying makeup, the method comprising:

providing the applicator of claim 1;

using the applicator to obtain at least one of two different makeup effects, wherein one make-up effect is obtained using applicator elements situated on the projection, and wherein another make-up effect is obtained using applicator elements situated on at least one of the portions.

46. An applicator configured to apply a substance to keratinous fibers, the applicator comprising:

a support;

at least one strip associated with the support; and a plurality of applicator elements comprising at least one of hooks and loops extending from the at least one strip, wherein the at least one strip defines at least one portion folded double defining a pair of substantially co-extensive side faces forming a cross-sectional length dimension, wherein the support is located adjacent one end of the cross-sectional length dimension, and wherein the at least one strip defines at least one location comprising some of the applicator elements of the plurality of applicator elements, a radius of curvature that is less than or equal to about 2 millimeters.

47. The applicator of claim 46, wherein the keratinous fibers comprise at least one of eyelashes and eyebrows.

48. A device for packaging and applying a substance, the device comprising:

a receptacle for containing the substance; and and the applicator of claim 46.

49. The device of claim 48, wherein the substance comprises at least one of a cosmetic product end a care product.

50. A method for applying makeup, the method comprising:

providing the applicator of claim 46;

using the applicator to obtain at least one of two different makeup effects, wherein one make-up effect is obtained using applicator elements situated on a the one portion of the strip, and wherein another make-up effect is obtained using applicator elements situated on at least one of the side faces of the strip.

* * * * *

UNITED STATES PATENT AND TRADEMARK OFFICE

CERTIFICATE OF CORRECTION

PATENT NO. : 7,490,616 B2
APPLICATION NO. : 10/854152
DATED : February 17, 2009
INVENTOR(S) : Jean-Louis H. Gueret It is certified that error appears in the above-identified patent and that said Letters Patent is hereby corrected as shown below:

Claim 19, col. 12, line 19, “of claim 1. wherein” should read --of claim 1, wherein--.

Claim 49, col. 14, line 18, “end a care product” should read --and a care product--.

Signed and Sealed this

Seventh Day of April, 2009

JOHN DOLL
*Acting Director of the United States Patent and Trademark Office*